US011149529B2

(12) United States Patent
Robey et al.

(10) Patent No.: US 11,149,529 B2
(45) Date of Patent: Oct. 19, 2021

(54) BALLISTIC COUPLING OF PERFORATING ARRAYS

(71) Applicant: Halliburton Energy Services, Inc., Houston, TX (US)

(72) Inventors: Richard Robey, Mansfield, TX (US); Joseph MacGillivray, Fort Worth, TX (US); Nicholas Harrington, Midlothian, TX (US); Jason Metzger, Joshua, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 254 days.

(21) Appl. No.: 16/321,805

(22) PCT Filed: Nov. 17, 2017

(86) PCT No.: PCT/US2017/062310

§ 371 (c)(1),
(2) Date: Jan. 29, 2019

(87) PCT Pub. No.: WO2019/099026

PCT Pub. Date: May 23, 2019

(65) Prior Publication Data

US 2021/0054724 A1 Feb. 25, 2021

(51) Int. Cl.

| | |
|---|---|
| ***E21B 43/1185*** | (2006.01) |
| ***E21B 43/117*** | (2006.01) |
| *E21B 43/119* | (2006.01) |

(52) U.S. Cl.

CPC ..... *E21B 43/11857* (2013.01); *E21B 43/117* (2013.01); *E21B 43/119* (2013.01)

(58) Field of Classification Search

CPC . E21B 43/11857; E21B 43/117; E21B 43/119
See application file for complete search history.

(56) References Cited

U.S. PATENT DOCUMENTS

| | | | |
|---|---|---|---|
| 3,238,019 | A | 3/1966 | De |
| 3,561,361 | A | 2/1971 | Kessenich et al. |

(Continued)

FOREIGN PATENT DOCUMENTS

| | | |
|---|---|---|
| WO | 2017070267 | 4/2017 |

OTHER PUBLICATIONS

International Search Report and Written Opinion for Application No. PCT/US2017/062310 dated Aug. 10, 2018.

*Primary Examiner* — Taras P Bemko
*Assistant Examiner* — Yanick A Akaragwe
(74) *Attorney, Agent, or Firm* — John Wustenberg; C. Tumey Law Group PLLC

(57) ABSTRACT

A method of perforating a subterranean formation may comprise: inserting into a wellbore a perforating gun assembly comprising: a first gun assembly comprising a first perforating explosive and a first ballistic transfer element; a transfer assembly comprising a second ballistic transfer element; and a second gun assembly comprising a second perforating explosive, wherein the first gun assembly and the second gun assembly are separated from the transfer assembly by a discontinuity; detonating the first perforating explosive; propagating a ballistic signal from the first gun assembly, across the discontinuity, to the transfer assembly; propagating a ballistic signal though the transfer assembly to the second ballistic transfer element; propagating a ballistic signal from the transfer assembly, across the discontinuity, to the second gun assembly; and detonating the second perforating explosive.

20 Claims, 4 Drawing Sheets

(56) References Cited

U.S. PATENT DOCUMENTS

| | | | | |
|---|---|---|---|---|
| 4,649,822 | A | 3/1987 | Seeman | |
| 4,850,438 | A | 7/1989 | Regalbuto | |
| 5,551,520 | A | 9/1996 | Bethel et al. | |
| 5,603,379 | A | 2/1997 | Henke et al. | |
| 5,971,072 | A | 10/1999 | Huber et al. | |
| 2012/0018157 | A1 | 1/2012 | Gill et al. | |
| 2013/0048376 | A1* | 2/2013 | Rodgers | E21B 43/1195 175/4.6 |
| 2019/0145216 | A1* | 5/2019 | Shampine | E21B 43/119 166/75.15 |

* cited by examiner

BALLISTIC COUPLING OF PERFORATING ARRAYS

BACKGROUND

After drilling various sections of a subterranean wellbore that traverses a formation, a casing string may be positioned and cemented within the wellbore. This casing string may increase the integrity of the wellbore and may provide a path for producing fluids from the producing intervals to the surface. To produce fluids into the casing string, perforations may be made through the casing string, the cement, and a short distance into the formation.

These perforations may be created by detonating a series of shaped charges that may be disposed within the casing string and may be positioned adjacent to the formation. Specifically, one or more perforating guns may be loaded with shaped charges that may be connected with a detonator via a detonating cord. The perforating guns may then be attached to a tool string that may be lowered into the cased wellbore. Once the perforating guns are properly positioned in the wellbore such that the shaped charges are adjacent to the formation to be perforated, the shaped charges may be detonated, thereby creating the desired perforations.

Conventional perforating guns are limited to one or two ballistic trains and do not have signal redundancy. Conventional perforating workstrings are also not capable of shooting multiple devices at the same wellbore elevation that are not coaxial.

BRIEF DESCRIPTION OF THE DRAWINGS

These drawings illustrate certain aspects of some examples of the present disclosure, and should not be used to limit or define the disclosure.

DETAILED DESCRIPTION

This disclosure may generally relate to systems and methods for perforating downhole tubulars, such as, for example casing. Present perforating gun assemblies are limited to a single ballistic train used with a single coaxial workstring of perforators. Perforating gun assemblies may comprise all components required to detonate charges to perforate a casing. A perforating gun assembly may comprise one or more perforating guns and transfer assemblies configured to transfer ballistic energy from one perforating gun to another perforating gun. Each transfer assembly may comprise an array of explosive elements such as boosters, detonation cord, explosive pellets, shaped charges, and other explosive elements for wellbore use.

The perforating gun assembly may be positioned on an outer surface of a tubular disposed in a wellbore. The tubular may be any tubular such as, without limitation, a work string, production tubing, workover tubing, and combinations thereof. A perforating gun assembly comprising multiple perforating guns and transfer assemblies may allow individual perforating guns to be positioned at multiple points along the tubular. Each perforating gun may be individually placed on a selected position on the tubular such that a selected zone may be perforated when the tubing is positioned within a wellbore.

Figure 1A:
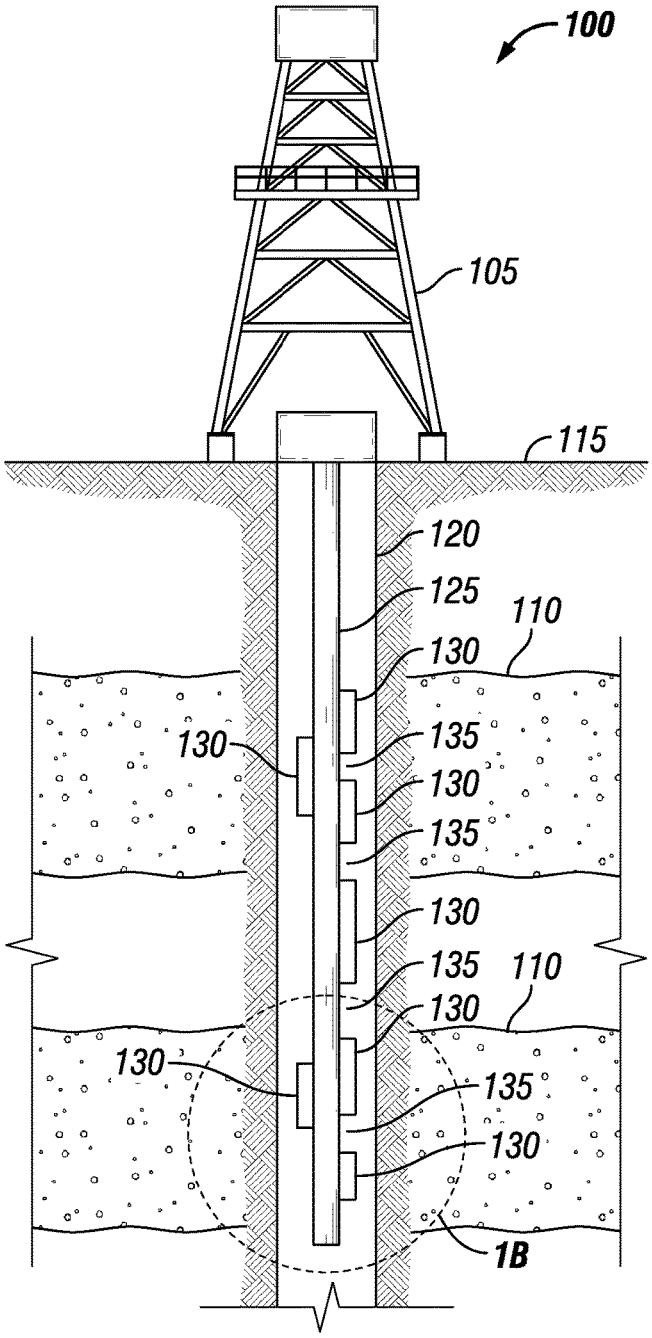
FIG. 1A is a schematic illustration of a wellbore with a plurality of perforating gun assemblies disposed therein.
Figure 1B:
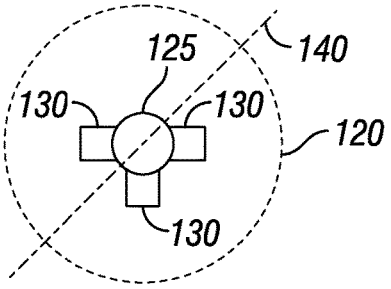
FIG. 1B is a schematic illustration of perforating gun assemblies disposed on a tubular.

FIG. 1A illustrates an example of a downhole perforating system 100 operating from rig 105. Rig 105 may be centered over a subterranean formation 110 located below the surface 115. A wellbore 120 may extend from surface 115 to penetrate subterranean formation 110. Wellbore 120 may comprise a casing cemented in place. A tubular 125 may extent from surface 115 though wellbore 120. Tubular 125 may be any tubular, such as a work string, configured to convey a plurality of perforating gun assemblies 130 though wellbore 120. The perforating gun assemblies 130 may be positioned such that explosive elements, such as perforating explosives contained within perforating gun assemblies 130, may perforate subterranean formation 110. It should be noted that while FIG. 1 generally depicts a land based operation, those of ordinary skill in the art will readily recognize that the principles described herein are equally applicable to subsea systems, without departing from the scope of the disclosure Wellbore 120 may extend through the various earth strata including subterranean formation 110. While perforating gun assemblies 130 are disposed in a vertical section of wellbore 110, wellbore 110 may include horizontal, vertical, slanted, curved, and other types of wellbore geometries and orientations, as will be appreciated by those of ordinary skill in the art. When it is desired to perforate subterranean formation 110, the perforating gun assemblies 130 may be lowered through a casing until the perforating gun assemblies 130 are properly positioned relative to subterranean formation 110. The perforating gun assemblies 130 may be attached to and lowered via tubular 125, which may include a tubing string, wireline, slick line, coil tubing, work string or other conveyance. Thereafter, explosive elements within perforating gun assemblies 130 may be fired. As will be discussed in more detail below, a ballistic signal may traverse across discontinuity 135 such that each perforating gun assembly 130 may receive the ballistic signal. Explosive elements contained in the perforating gun assemblies may comprise shaped charges, which upon detonation may form jets that may create a spaced series of perforations extending outwardly through a casing, cement, and into subterranean formation 110, thereby allowing formation communication between subterranean formation 110 and wellbore 120. In addition to the use of shaped charges, the perforating gun assemblies 130 may be readily substituted with similar tools that contain other oilfield ordinance such as propellants or venting devices known to those of ordinary skill in the art. With reference to inset FIG. 1B, perforating gun assemblies 130 may be disposed on tubular 125 such that perforating gun assemblies 130 are not co-axial along axis 140. This configuration may allow perforation of zones at the same wellbore elevation that are not co-axial.

Figure 2:
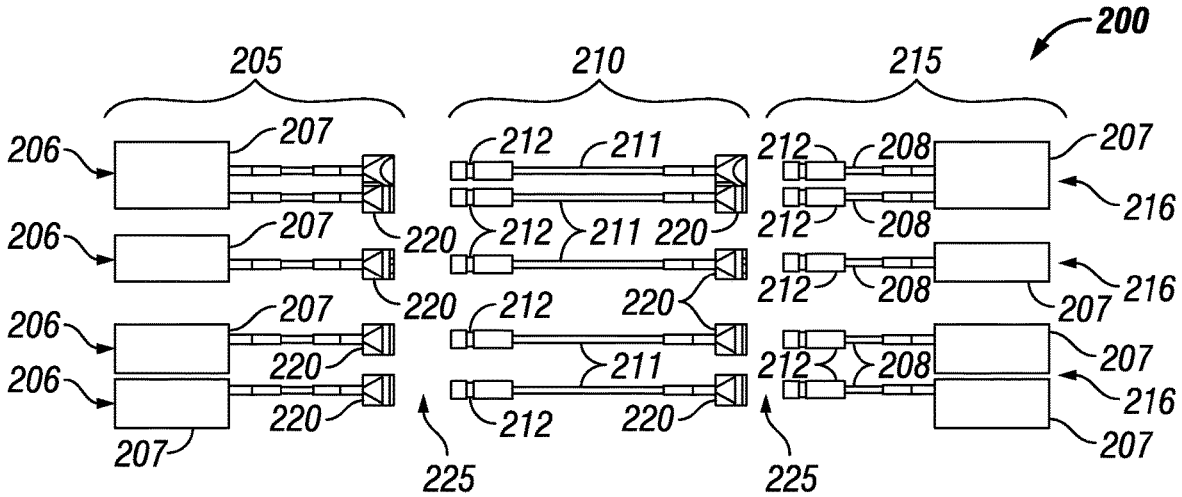
FIG. 2 is a schematic illustration of a perforating gun assembly.

FIG. 2 illustrates an example of a perforating gun assembly 200. Perforating gun assembly 200 may comprise first gun assembly 205, transfer assembly 210, and second gun assembly 215. As previously described, perforating gun assembly 200 may circumscribe a central member such as a tubular, not illustrated. First gun assembly 205 and second gun assembly 215 may be separated from transfer assembly 210 by water gap 225.

First gun assembly 205 may comprise a plurality of first perforating guns 206 which may be positioned around the central member to perforate a target zone. First perforating guns 206 may comprise explosive element 207 which may comprise shaped charges or other explosive charges for perforating a casing or subterranean formation. First perforating guns 206 may further comprise ballistic transfer line 208 that ballistically couples explosive element 207 with ballistic transfer element 220. Explosive element 207 may receive a signal and fire the explosive elements contained therein which may transfer ballistic energy into ballistic transfer line 208 and into ballistic transfer element 220. Ballistic transfer line 208 may comprise an explosive, such as detonation cord, capable of carrying a ballistic signal to ballistic transfer element 220.

First perforating gun 206 may comprise one or more ballistic transfer lines 208. As illustrated in FIG. 2, the topmost first perforating gun 206 has two ballistic transfer lines 208 while the middle and bottom first perforating gun 206 have one ballistic transfer line 208. More than one ballistic transfer line 208 may be provided for timing or signal redundancy. The ballistic signal propagating through ballistic transfer line 208 may take relatively longer to traverse a longer ballistic transfer line than a shorter ballistic transfer line. Ballistic transfer line 208 may transfer the propagating ballistic signal to ballistic transfer element 220 causing ballistic transfer element 220 to detonate.

Each ballistic transfer line 208 and ballistic transfer element 220 may be positioned such that an end of ballistic transfer element 220 may be aligned with an end of an independent transfer sub 211. Ballistic transfer element 220, which may comprise a shaped charge, explosive pellet, booster, flyer plate, or any other explosive element capable of transferring a ballistic signal which may traverse water gap 225 to independent transfer sub 211. For example, a jet from a shaped charge may be considered a ballistic signal that traverses the discontinuity of the water gap. As used herein, the term ballistic signal may refer to a detonation, or kinetic energy, that travels through or across explosive materials such as detonation cord, shaped charge, booster, explosive pellet, and other explosive elements well known in the art, to reach another explosive material. For instance a shaped charge may fire across a discontinuity in the perforating string, or as a shock wave that may propagate between explosive components. Either of these examples may exemplify the communication of the ballistic signal. The shock wave from a nearby detonation may cause an explosive pellet 212 on the receiving independent transfer sub 211 to detonate. Independent transfer sub 211 may comprise detonation cord which may be detonated by explosive pellet 212, thereby continuing to send the ballistic signal though independent transfer sub 211. One of ordinary skill in the art will understand that explosive pellet 212 may be substituted for any appropriate explosive medium that is capable of propagating the ballistic signal. A ballistic transfer element 220 may be positioned on the distal end of independent transfer sub 211. In some instances, ballistic transfer element 220 may consist of a shaped charge, or an explosive in contact with a material that is to traverse the discontinuity. Once detonated the explosives may force material towards the target, creating a flyer plate. Either the jet from a shaped charge or a flyer plate caused by the detonation of ballistic transfer element 220 may cause the explosive pellet 212 to detonate once the ballistic signal crosses the discontinuity. Independent transfer sub 211 may be positioned on a central member axially displaced from ballistic transfer element 220 is in line with a proximal end of second gun assembly 215.

Second gun assembly 215 may comprise a plurality of second perforating guns 216. Second perforating guns 216 may receive a ballistic signal from ballistic transfer element 220 on independent transfer sub 211 which has traversed across the discontinuity caused by water gap 225. The ballistic signal may detonate explosive pellet 212 which may in turn detonate ballistic transfer line 208 and send the ballistic signal to explosive element 207.

The configuration of first gun assembly 205, transfer assembly 210, and second gun assembly 215 may allow a ballistic signal to propagate from explosive element 207 on first gun assembly 205 through to explosive element 207 on second perforating guns 216. These arrangements may not have ballistic signal mixing, and each ballistic signal may be able to travel at its own rate. In some instances, ballistic signals for different ballistic trains may arrive at different times in wellbore 120 as illustrated in FIG. 1.

Figure 3:
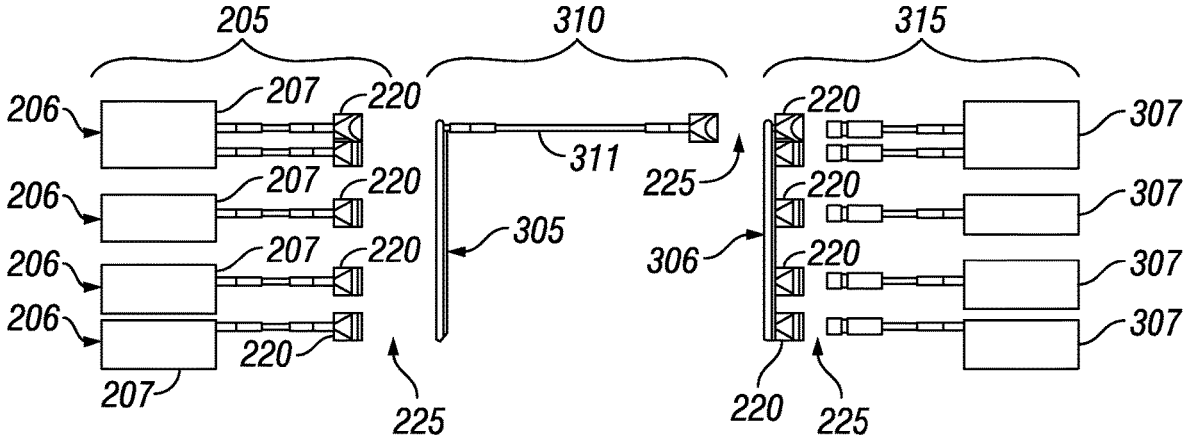
FIG. 3 is a schematic illustration of a perforating gun assembly.

With reference to FIG. 3, an alternate perforating gun assembly 300 may comprise the same first gun assembly 205 configured and positioned as in FIG. 2 with differing elements for transfer assembly 310 and second gun assembly 315. Instead of the ballistic energy from ballistic transfer element 220 traversing the discontinuity with the ballistic signal to a single explosive pellet, a detonation cord ring 305 may be placed at the proximal end of independent transfer sub 311. Detonation cord ring 305 may be detonated by ballistic transfer element 220 positioned on first perforating gun 206. Although referred to herein as a detonation cord ring, one of ordinary skill in the art would understand that a detonation cord ring may be substituted for any appropriate explosive such as explosive pellets or an explosive sheet in any of the configurations described in this disclosure. The addition of detonation cord ring 305 may provide redundancy to each ballistic transfer element 220 such that the ballistic signal from explosive element 207 has an increased chance of reaching independent transfer sub 311. As previously described, independent transfer sub 311 may comprise detonation cord or another explosive component that is capable of carrying a ballistic signal. Detonation cord ring 305 may be connected to a detonation cord or explosive element within independent transfer sub 311 such that the ballistic signal may be further propagated to ballistic transfer element 220 positioned on the distal end of independent transfer sub 311. A ballistic signal from explosive element 207 positioned within first perforating gun 206 may traverse through ballistic transfer line 208 and into ballistic transfer element 220 which may further propagate across water gap 225 to detonation cord ring 305 and through independent transfer sub 211 to ballistic transfer element 220.

Second gun assembly 315 may comprise a second detonation cord ring 306, a plurality of ballistic transfer elements 220, explosive pellet 212, explosive transfer line 208, and explosive element 307. Second detonation cord ring 306 may be positioned such that the ballistic signal from ballistic transfer element 220 positioned on the proximal end of independent transfer sub 211 may propagate across water gap 225 to second detonation cord ring 306. Second detonation cord ring 306 may be attached to a plurality of ballistic transfer element 220 to further propagate the ballistic signal across water gap 225. The ballistic signal may traverse water gap 225 and detonate explosive pellet 212 which may further detonate explosive elements within ballistic transfer line 208 and thereby transferring the ballistic signal into explosive elements 307. The configuration of FIG. 3 may allow a ballistic signal to travel from explosive element 207 of first gun assembly 206 across multiple discontinuities to explosive elements 307 in second gun assembly 315. Explosive elements 307 may comprise the same explosive elements as explosive elements 207, such as shaped charges and other perforating explosives. The arrangement in FIG. 3 may comprise ballistic signal mixing. Ballistic signal mixing may allow for relatively less precise tangential or phased alignment of first gun assembly 205, transfer assembly 310, and second gun assembly 315. While the arrangement of FIG. 3 may be described as untimed, one of ordinary skill will appreciate that relative arrival times or signal lag of a first and a last ballistic signal traversing the work string may be small. The small signal lag may be attributed to the resetting and randomizing of the first in, first out of the ballistic signals that arrive between first gun assembly 205 to transfer assembly 310 and from transfer assembly 310 to second gun assembly 315. The arrangement of FIG. 3 may also reinitiate a ballistic string that may have a stop fire or ballistic signal loss condition above first gun assembly 205. Although depicted in FIG. 3 as comprising only two gun assemblies, there may be multiple gun assemblies that form a ballistic train.

As previously mentioned, perforating gun assembly 200 and 300 may comprise timed or untimed outputs. An example of an untimed output may be where a first gun assembly (denoted 205 in FIGS. 2 and 3) converges to a transfer assembly (denoted 210 in FIGS. 2 and 310 in FIG. 3) where each path is the same length and then diverges to a second gun assembly (denoted 215 in FIGS. 2 and 315 in FIG. 3). The ballistic signal from each explosive element in each first perforating gun may take different paths where the relative time of arrival of each ballistic signal reaching the second gun assemblies is essentially uncontrolled. In theory a ballistic signal traversing from a plurality of first gun assemblies should reach a plurality of second gun assemblies at the same time if all ballistic paths are completely uniform in length. One of ordinary skill will appreciate that in practice there may be variability in the lengths and other physical characteristics of the ballistic paths which may cause the plurality ballistic signals to become desynchronized from each other causing them to arrive at the second gun assemblies at slightly different times.

Figure 4A:
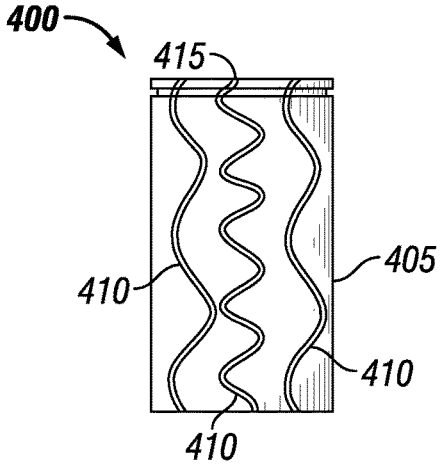
FIG. 4A is a schematic illustration of a timed array.

An alternative to an untimed gun assembly is a gun assembly with a timed output. A timed output may be achieved by configuring an independent transfer sub to accept one ballistic signal that diverges to a multitude of signals. The input ballistic signal may initiate a pattern of explosives such that each output signal may be configured to arrive at a desired location and time. An example of such an array is shown in FIG. 4A. Timed array 400 may comprise a body 405, one or more ballistic transfer paths 410, and a ballistic input 415. Ballistic input 415 may transfer a ballistic signal to each ballistic transfer path 410 such that a single input signal may branch into multiple output signals. Each ballistic transfer path 410 may comprise an explosive element, such as detonation cord, or any other explosive element that is capable of propagating a ballistic signal. A length of each ballistic transfer path 410 may be independently selected such that a ballistic signal carried by a particular ballistic transfer path 410 may be timed to arrive at a location at the same time as other ballistic transfer path 410. Ballistic input 415 may be any explosive capable of carrying a ballistic signal such as a ring of detonation cord as in FIG. 3. As one of ordinary skill will appreciate, a detonation cord ring may not deliver a ballistic signal to each ballistic transfer path 410 at the same time as the ballistic signal may needs time to traverse the entire length of the detonation cord ring to reach each ballistic transfer path 410. As illustrated in FIG. 4A, a ballistic transfer path may have a tortuous geometry such that even if the input signal does not reach each ballistic transfer path at the same time, the tortuous path the ballistic signal travels causes an output ballistic signal from each ballistic transfer path to arrive at the same time. A ballistic transfer path 410 may circumscribe a geometry about a length and diameter of an individual transfer sub in any way to achieve the proper timing of the ballistic signal.

Figure 4B:
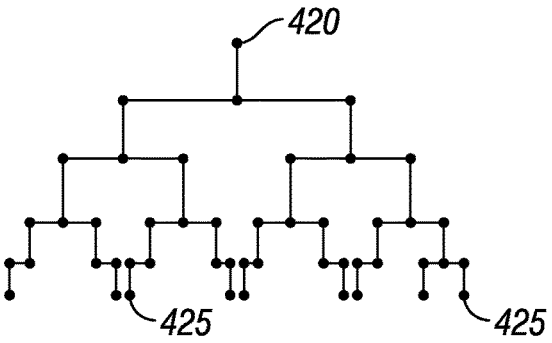
FIG. 4B is a schematic illustration of a timed array.

As illustrated in FIG. 4B, the equivalent to a curved geometry of FIG. 4A is a straight line geometry of FIG. 4B. An input signal 420 may branch into multiple signals that arrive at the output signal 425 at the same time since each signal path to each output signal 425 is the same length. A straight line geometry may be disposed on body 405 as in FIG. 4A. Although a timed array has been described for an individual transfer sub, one of ordinary skill in the art will understand that any component of a gun assembly may be timed using the aforementioned techniques.

The arrays of any of the figures and systems of this disclosure may have been described in absolute terms such as the signals arriving at the same time. One or ordinary skill would understand that a ballistic signal may travel at a relatively slower or faster rate depending on many factors including, but not limited to, wellbore conditions. Additionally, a ballistic transfer path may be inadvertently shortened or lengthened during manufacture and assembly causing a path to be relatively shorter or longer compared to other ballistic transfer paths within the same timing element, gun component, or transfer assembly. One of ordinary skill will appreciate that a timing element may comprise a timing error or difference in arrival time of each ballistic signal to an end of the timing element of about 0.000000 seconds to about 0.020000 seconds. Alternatively, about 0.000001 seconds to about 0.000010 seconds, about 0.000001 seconds to about 0.000100 seconds, about 0.000001 seconds to about 0.001000 seconds, or about 0.000001 seconds to about 0.0020000 seconds. One of ordinary skill in the art will further appreciate that timing errors may occur in other examples as described herein. A timing error may occur in any element capable of conveying a ballistic signal. The timing errors in such an element may comprise the error ranges recited above. For example, FIG. 3 multiple ballistic transfer lines and ballistic transfer elements, each of which may comprise a timing error.

Figure 5:
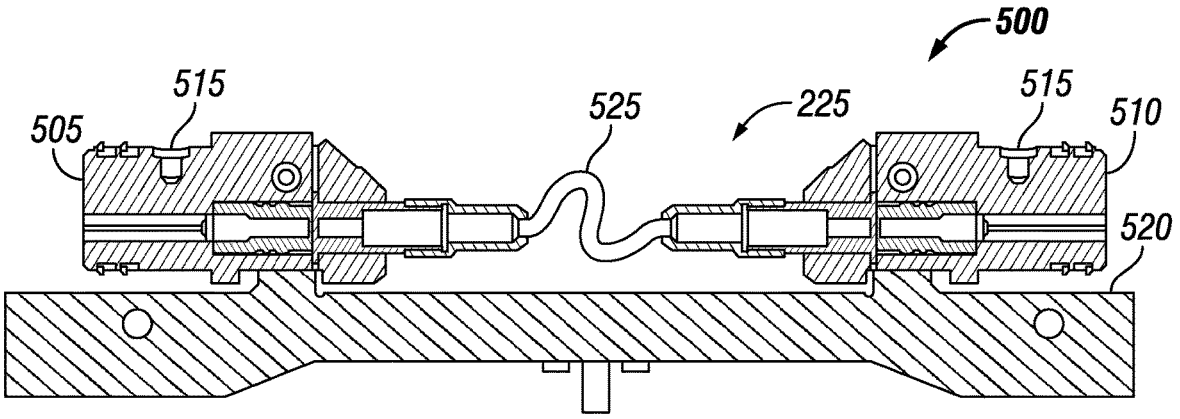
FIG. 5 is a schematic illustration of a perforating gun assembly.

With reference to FIG. 5, an alternate configuration to traverse a water gap 225 is illustrated. Perforating system 500 may comprise perforating guns 505 and 510 which may be disposed of on a tubular 520. Each perforating gun may comprise perforating explosives 515. Perforating guns 505 and 510 may be coupled to detonation cord 525 which may carry a ballistic signal from perforating gun 505 to perforating gun 510 to traverse water gap 225. The configuration of perforating gun 505 and 510 as well as detonation cord 525 may be incorporated in any examples presented herein to traverse a water gap 225.

Figure 6A:
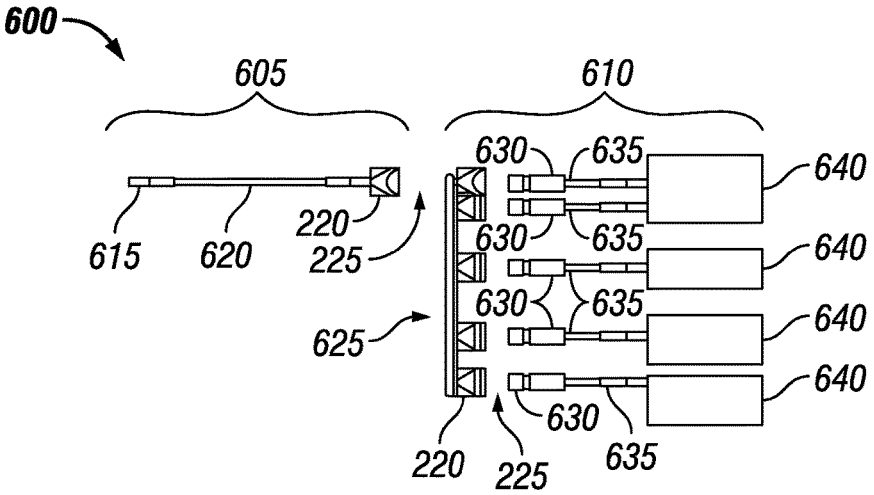
FIG. 6A is a schematic illustration of a perforating gun assembly with a firing head.

With reference to FIG. 6A, a perforating assembly 600 is illustrated. Perforating assembly 600 may comprise transfer assembly 605 and perforating gun assembly 610. Transfer assembly 605 may further comprise firing head 615, ballistic transfer line 620 and ballistic transfer element 220. Firing head 615 may comprise a mechanical or electronic device that may be actuated from a surface of a wellbore to initiate a detonator. The detonator may be contained within firing head 615 and may be coupled to ballistic transfer line 620. Ballistic transfer line 620 may comprise detonation cord or other explosives capable of carrying a ballistic signal to ballistic transfer element 220. Perforating gun assembly 610 may comprise a detonation cord ring 625 coupled to ballistic transfer elements 220 and explosive pellet 630 coupled to ballistic transfer line 635 which in turn is coupled to explosive element 640. As in previous examples, a ballistic signal from firing head 615 may traverse though ballistic transfer line 620 to ballistic transfer element 220. A ballistic signal sent from ballistic transfer element 220 may traverse water gap 225 to detonation cord ring 625 which may detonate ballistic transfer elements 220 coupled thereto. The ballistic signal may traverse water gap 225 to reach explosive pellet 630 which may further propagate the ballistic signal to explosive element 640 though ballistic transfer line 635. Each ballistic transfer element 220 may be aligned such that a ballistic signal propagating from firing head 615 may traverse any discontinuities such as water gap 225 to reach explosive element 640. Explosive element 640 may comprise perforating charges or other explosives as previously described.

Figure 6B:
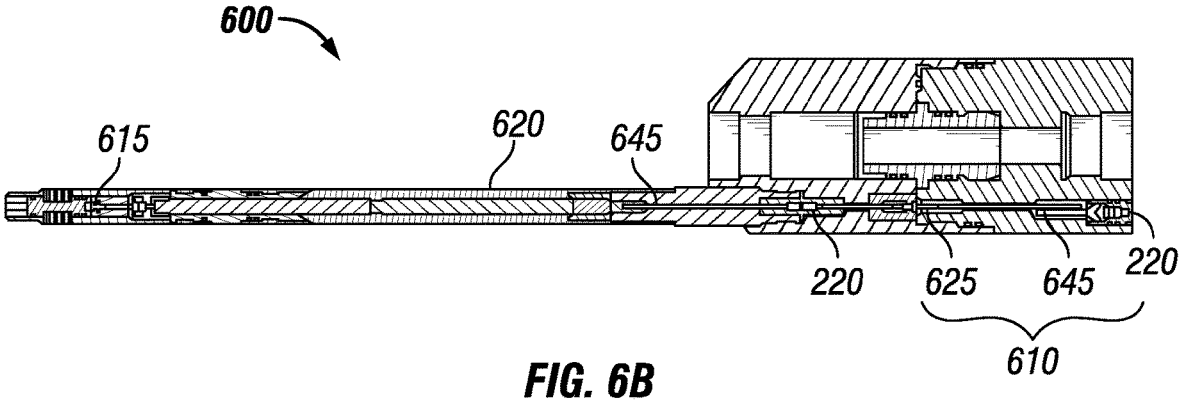
FIG. 6B is a schematic illustration of a perforating gun assembly with a firing head.

With reference to FIG. 6B, a more detailed perforating assembly 600 is illustrated without a complete perforating gun assembly 610. As illustrated, firing head 615 may be placed at the proximal end of perforating assembly 600 which may be coupled to ballistic transfer line 620. FIG. 6B also illustrates a cutaway of ballistic transfer line 620 wherein detonation cord 645 may be disposed. Detonation cord 645 may couple firing head 615 to ballistic transfer element 220. Ballistic transfer element 220 may transfer a ballistic signal from detonation cord 645 to detonation cord ring 625 which may then further propagate the ballistic signal to detonation cord 645 and to ballistic transfer element 220. Only a partial view of perforating gun assembly 610 is shown. The ballistic transfer element 220 on the distal end of perforating assembly 600 may transfer the ballistic signal to explosive pellet 630 as show in FIG. 6A. FIGS. 6A and 6B are untimed arrays as the ballistic signal traversing detonation cord ring 625 may not reach multiple detonation cord 645 at the same time should more than one detonation cord 645 be present.

Figure 7A:
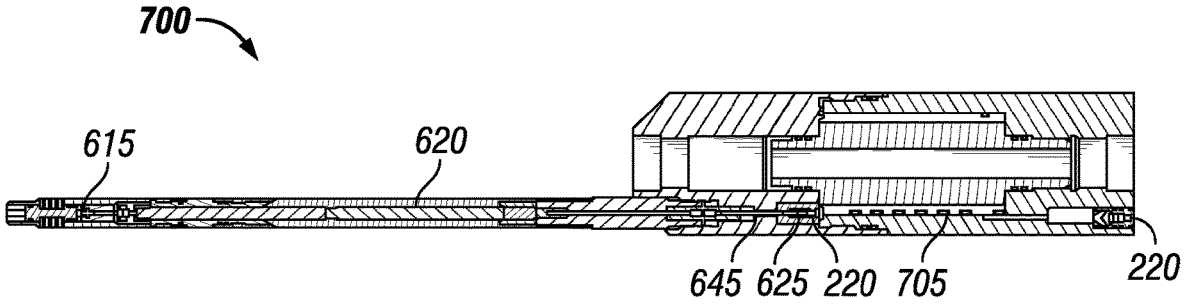
FIG. 7A is a schematic illustration of a timed perforating gun assembly with a firing head.

With reference to FIG. 7A, a perforating assembly 700 is illustrated. Perforating assembly 700 may be configured as in FIG. 6B with the addition of timing element 705. Timing element 705 may comprise a timed array as previously illustrated in FIG. 4A. As in FIG. 6B, firing head 615 may detonate upon receiving a signal which may send a ballistic signal to ballistic transfer line 620 to ballistic transfer element 220 though detonation cord 645. Timing element 705 may receive the ballistic signal as an input ballistic signal and split the input ballistic signal into multiple output ballistic signals. The output ballistic signals may traverse a tortuous path such that each output ballistic signal arrives at and end of timing element 705 at the same time. Each output ballistic signal may be coupled to a ballistic transfer element 220.

Figure 7B:
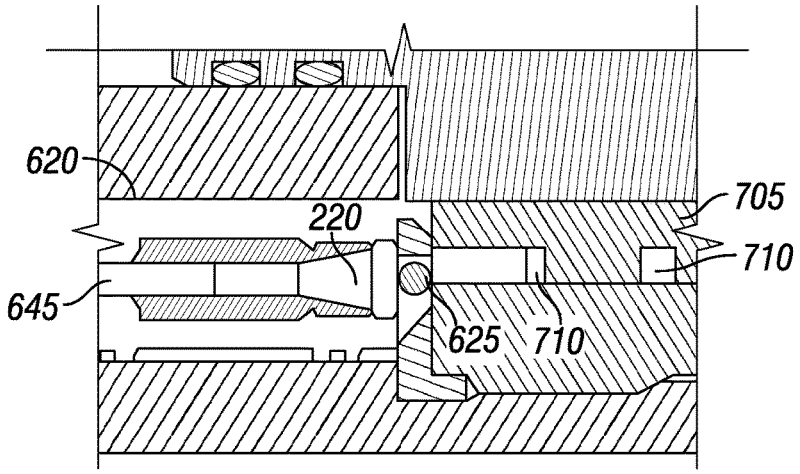
FIG. 7B is a schematic illustration of a timed perforating gun assembly with a firing head.

FIG. 7B illustrates a more detailed view of ballistic transfer element 220 interacting with timing element 705. Detonation cord 645 may be disposed inside ballistic transfer line 620 and coupled to ballistic transfer element 220. Ballistic transfer element 220 may send a ballistic signal to timing element 705 which may comprise ballistic transfer path 710. As illustrated in FIG. 7B, ballistic transfer path 710 may circumscribe timing element 705 such that the length of ballistic transfer path 710 may control the length of time the ballistic signal spends within timing element 705. Adjusting the length of each ballistic transfer path may allow each output ballistic signal to be timed to reach a ballistic transfer element at a chosen time.

The systems and methods may include any of the various features of the systems and methods disclosed herein, including one or more of the following statements.

Statement 1. A method of perforating a subterranean formation comprising: inserting into a wellbore a perforating gun assembly comprising: a first gun assembly comprising a first perforating explosive and a first ballistic transfer element; a transfer assembly comprising a second ballistic transfer element; and a second gun assembly comprising a second perforating explosive, wherein the first gun assembly and the second gun assembly are separated from the transfer assembly by a discontinuity; detonating the first perforating explosive; propagating a ballistic signal from the first gun assembly, across the discontinuity, to the transfer assembly; propagating a ballistic signal though the transfer assembly to the second ballistic transfer element; propagating a ballistic signal from the transfer assembly, across the discontinuity, to the second gun assembly; and detonating the second perforating explosive.

Statement 2. The method of statement 1 wherein the perforating gun assembly is disposed on an outside surface of a tubular.

Statement 3. The method of statements 1 or 2 wherein first perforating explosive and first ballistic transfer element are explosively coupled.

Statement 4. The method of any previous statement wherein the first ballistic transfer element propagates the ballistic signal to the transfer assembly across the discontinuity.

Statement 5. The method of any previous statement wherein the first ballistic transfer element comprises a shaped charge.

Statement 6. The method of any previous statement wherein the transfer assembly further comprises a first receiving explosive which receives the ballistic signal from the first gun assembly and wherein the second gun assembly further comprises a second receiving explosive which receives the ballistic signal from the transfer assembly.

Statement 7. The method of any previous statement wherein the second receiving explosive and the second perforating explosive are explosively coupled.

Statement 8. The method of any previous statement wherein the transfer assembly further splits a ballistic signal into a plurality of ballistic signals, wherein the plurality of ballistic signals traverse a timing element comprising ballistic transfer paths, wherein the ballistic transfer paths sync the plurality of ballistic signals such that the plurality of ballistic signals arrive at an end of the timing element within a time period of about 0.000000 seconds to about 0.020000 seconds of each other.

Statement 9. A system for perforating a subterranean formation comprising: a first gun assembly comprising a first perforating explosive; a transfer assembly, wherein the transfer assembly and the first gun assembly are separated by a first discontinuity; and a second gun assembly comprising a second perforating explosive, wherein the second gun assembly and the transfer assembly are separated by a second discontinuity; wherein the transfer assembly is configured to receive a ballistic signal from the first gun assembly and the second gun assembly is configured to receive a ballistic signal from the transfer assembly.

Statement 10. The system of statement 9 wherein the first gun assembly, the transfer assembly, and the second gun assembly are disposed on an outside surface of a tubular.

Statement 11. The system of statements 9 or 10 wherein the first gun assembly further comprises a first explosive coupled to the first perforating explosive and a first ballistic transfer element, wherein the first explosive is configured to transfer a ballistic signal from the first perforating explosive to the first ballistic transfer element.

Statement 12. The system of statements 9-11 wherein the transfer assembly further comprises a first receiving explosive and a second explosive coupled to the first receiving explosive and a second ballistic transfer element, and wherein the second explosive is configured to propagate a ballistic signal from the first receiving explosive to the second ballistic transfer element.

Statement 13. The system of statements 9-12 wherein the first receiving explosive comprises an explosive ring, an explosive pellet, or an explosive sheet.

Statement 14. The system of statements 9-13 wherein the second explosive comprises a plurality of ballistic transfer paths and wherein first receiving explosive is configured to split the ballistic signal into a plurality of ballistic signals and send the plurality of ballistic signals through the plurality of ballistic transfer paths such that the plurality of ballistic signals arrive at the second ballistic transfer element in a time period of about 0.000000 seconds to about 0.020000 seconds of each other.

Statement 15. The system of statements 9-14 wherein the second gun assembly further comprises a second receiving explosive and a third explosive coupled to the second receiving explosive and the second perforating explosive, and wherein the third explosive is configured to propagate a ballistic signal from the second receiving explosive to the second perforating explosive.

Statement 16. A perforating apparatus comprising: a transfer assembly; and a perforating gun assembly comprising a perforating explosive; wherein the transfer assembly and the perforating gun assembly are separated by a discontinuity, and wherein the transfer assembly is configured to propagate a ballistic signal to the perforating gun assembly.

Statement 17. The apparatus of statement 16 wherein the transfer assembly comprises a first ballistic transfer line coupled to a firing head and a ballistic transfer element, wherein the first ballistic transfer line is configured to propagate the ballistic signal from the firing head to the ballistic transfer element.

Statement 18. The system of statements 16-17 wherein the ballistic transfer element is configured to transfer a ballistic signal from the ballistic transfer element across the discontinuity to a receiving explosive on the perforating gun assembly.

Statement 19. The system of statements 16-18 wherein the receiving explosive is coupled to a second ballistic transfer line configured to propagate a ballistic signal to the perforating explosive.

Statement 20. The system of statements 16-19 wherein the transfer assembly further comprises a timing element configured to split a ballistic signal from the receiving explosive into a plurality of ballistic signals and propagate the plurality of ballistic signals to the perforating gun assembly such that the plurality of ballistic signals arrive at the perforating gun assembly within a time period of about 0.000000 seconds to about 0.020000 seconds of each other.

The preceding description provides various examples of the systems and methods of use disclosed herein which may contain different method steps and alternative combinations of components. It should be understood that, although individual examples may be discussed herein, the present disclosure covers all combinations of the disclosed examples, including, without limitation, the different component combinations, method step combinations, and properties of the system. It should be understood that the compositions and methods are described in terms of "comprising," "containing," or "including" various components or steps, the compositions and methods can also "consist essentially of" or "consist of" the various components and steps. Moreover, the indefinite articles "a" or "an," as used in the claims, are defined herein to mean one or more than one of the element that it introduces.

For the sake of brevity, only certain ranges are explicitly disclosed herein. However, ranges from any lower limit may be combined with any upper limit to recite a range not explicitly recited, as well as, ranges from any lower limit may be combined with any other lower limit to recite a range not explicitly recited, in the same way, ranges from any upper limit may be combined with any other upper limit to recite a range not explicitly recited. Additionally, whenever a numerical range with a lower limit and an upper limit is disclosed, any number and any included range falling within the range are specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values even if not explicitly recited. Thus, every point or individual value may serve as its own lower or upper limit combined with any other point or individual value or any other lower or upper limit, to recite a range not explicitly recited.

Therefore, the present examples are well adapted to attain the ends and advantages mentioned as well as those that are inherent therein. The particular examples disclosed above are illustrative only, and may be modified and practiced in different but equivalent manners apparent to those skilled in the art having the benefit of the teachings herein. Although individual examples are discussed, the disclosure covers all combinations of all of the examples. Furthermore, no limitations are intended to the details of construction or design herein shown, other than as described in the claims below. Also, the terms in the claims have their plain, ordinary meaning unless otherwise explicitly and clearly defined by the patentee. It is therefore evident that the particular illustrative examples disclosed above may be altered or modified and all such variations are considered within the scope and spirit of those examples. If there is any conflict in the usages of a word or term in this specification and one or more patent(s) or other documents that may be incorporated herein by reference, the definitions that are consistent with this specification should be adopted.

What is claimed is:

1. A method of perforating a subterranean formation comprising:

inserting into a wellbore a perforating gun assembly comprising:

a first gun assembly comprising a first perforating explosive and a first ballistic transfer element;

a transfer assembly comprising a second ballistic transfer element and a detonation cord ring; and a second gun assembly comprising a second perforating explosive, wherein the first gun assembly and the second gun assembly are separated from the transfer assembly by a discontinuity, wherein the first and second gun assemblies are disposed on a tubular such that the first and second gun assemblies are not co-axially aligned relative to a lateral axis extending through the tubular, wherein the transfer assembly is disposed on an outside surface of the tubular;

detonating the first perforating explosive;

propagating a ballistic signal from the first gun assembly, across the discontinuity, to the transfer assembly;

propagating a ballistic signal though the transfer assembly to the second ballistic transfer element;

propagating a ballistic signal from the transfer assembly, across the discontinuity, to the second gun assembly; and detonating the second perforating explosive.

2. The method of claim 1 wherein the perforating gun assembly is disposed on an outside surface of the tubular.

3. The method of claim 1 wherein first perforating explosive and first ballistic transfer element are explosively coupled.

4. The method of claim 3 wherein the first ballistic transfer element propagates the ballistic signal to the transfer assembly across the discontinuity.

5. The method of claim 3 wherein the first ballistic transfer element comprises a shaped charge.

6. The method of claim 1 wherein the transfer assembly further comprises a first receiving explosive which receives the ballistic signal from the first gun assembly and wherein the second gun assembly further comprises a second receiving explosive which receives the ballistic signal from the transfer assembly.

7. The method of claim 6 wherein the second receiving explosive and the second perforating explosive are explosively coupled.

8. A method of perforating a subterranean formation comprising:

inserting into a wellbore a perforating gun assembly comprising:

a first gun assembly comprising a first perforating explosive and a first ballistic transfer element;

a transfer assembly comprising a second ballistic transfer element; and a second gun assembly comprising a second perforating explosive, wherein the first gun assembly and the second gun assembly are separated from the transfer assembly by a discontinuity;

detonating the first perforating explosive;

propagating a ballistic signal from the first gun assembly, across the discontinuity, to the transfer assembly;

propagating a ballistic signal though the transfer assembly to the second ballistic transfer element;

propagating a ballistic signal from the transfer assembly, across the discontinuity, to the second gun assembly; and detonating the second perforating explosive, wherein the transfer assembly further splits a ballistic signal into a plurality of ballistic signals, wherein the plurality of ballistic signals traverse a timing element comprising ballistic transfer paths, wherein the ballistic transfer paths sync the plurality of ballistic signals such that the plurality of ballistic signals arrive at an end of the timing element within a time period of about 0.000000 seconds to about 0.020000 seconds of each other.

9. A system for perforating a subterranean formation comprising:

a first gun assembly comprising a first perforating explosive;

a transfer assembly comprising a detonation cord ring, wherein the transfer assembly and the first gun assembly are separated by a first discontinuity; and a second gun assembly comprising a second perforating explosive, wherein the second gun assembly and the transfer assembly are separated by a second discontinuity, wherein the first and second gun assemblies are disposed on a tubular such that the first and second gun assemblies are not co-axially aligned relative to a lateral axis extending through the tubular;

wherein the transfer assembly is configured to receive a ballistic signal from the first gun assembly and the second gun assembly is configured to receive a ballistic signal from the transfer assembly, wherein the transfer assembly is disposed on an outside surface of the tubular.

10. The system of claim 9, wherein the first gun assembly further comprises a first ballistic transfer element coupled to a first explosive and the first perforating explosive.

11. The system of claim 10, wherein the first explosive is configured to transfer a ballistic signal from the first perforating explosive to the first ballistic transfer element.

12. The system of claim 11 wherein the transfer assembly further comprises a first receiving explosive and a second explosive coupled to the first receiving explosive and a second ballistic transfer element, and wherein the second explosive is configured to propagate a ballistic signal from the first receiving explosive to the second ballistic transfer element.

13. The system of claim 12 wherein the first receiving explosive comprises an explosive ring, an explosive pellet, or an explosive sheet.

14. A system for perforating a subterranean formation comprising:

a first gun assembly comprising a first perforating explosive;

a transfer assembly, wherein the transfer assembly and the first gun assembly are separated by a first discontinuity; and a second gun assembly comprising a second perforating explosive, wherein the second gun assembly and the transfer assembly are separated by a second discontinuity;

wherein the transfer assembly is configured to receive a ballistic signal from the first gun assembly and the second gun assembly is configured to receive a ballistic signal from the transfer assembly; and wherein the second explosive comprises a plurality of ballistic transfer paths and wherein first receiving explosive is configured to split the ballistic signal into a plurality of ballistic signals and send the plurality of ballistic signals through the plurality of ballistic transfer paths such that the plurality of ballistic signals arrive at the second ballistic transfer element in a time period of about 0.000000 seconds to about 0.020000 seconds of each other.

15. A system for perforating a subterranean formation comprising:

a first gun assembly comprising a first perforating explosive;

a transfer assembly, wherein the transfer assembly and the first gun assembly are separated by a first discontinuity; and a second gun assembly comprising a second perforating explosive, wherein the second gun assembly and the transfer assembly are separated by a second discontinuity;

wherein the transfer assembly is configured to receive a ballistic signal from the first gun assembly and the second gun assembly is configured to receive a ballistic signal from the transfer assembly; and wherein the second gun assembly further comprises a second receiving explosive and a third explosive coupled to the second receiving explosive and the second perforating explosive, and wherein the third explosive is configured to propagate a ballistic signal from the second receiving explosive to the second perforating explosive.

16. A perforating apparatus comprising:

a transfer assembly comprising a detonation cord ring; and first and second perforating gun assemblies each comprising a perforating explosive, wherein the first and second gun assemblies are disposed on a tubular such that the first and second gun assemblies are not coaxially aligned relative to a lateral axis extending through the tubular;

wherein the transfer assembly and each perforating gun assembly are separated by a discontinuity, and wherein the transfer assembly is configured to propagate a ballistic signal to the second perforating gun assembly, wherein the transfer assembly is disposed on an outside surface of the tubular.

17. The apparatus of claim 16 wherein the transfer assembly comprises a first ballistic transfer line coupled to a firing head and a ballistic transfer element, wherein the first ballistic transfer line is configured to propagate the ballistic signal from the firing head to the ballistic transfer element.

18. The apparatus of claim 17 wherein the ballistic transfer element is configured to transfer a ballistic signal from the ballistic transfer element across the discontinuity to a receiving explosive on the perforating gun assembly.

19. The apparatus of claim 18 wherein the receiving explosive is coupled to a second ballistic transfer line configured to propagate a ballistic signal to the perforating explosive.

20. A perforating apparatus comprising:

a transfer assembly; and a perforating gun assembly comprising a perforating explosive;

wherein the transfer assembly and the perforating gun assembly are separated by a discontinuity, and wherein the transfer assembly is configured to propagate a ballistic signal to the perforating gun assembly; and wherein the transfer assembly further comprises a timing element configured to split a ballistic signal from the receiving explosive into a plurality of ballistic signals and propagate the plurality of ballistic signals to the perforating gun assembly such that the plurality of ballistic signals arrive at the perforating gun assembly within a time period of about 0.000000 seconds to about 0.020000 seconds of each other.

* * * * *